US009557066B2

(12) United States Patent
Claussen et al.

(10) Patent No.: US 9,557,066 B2
(45) Date of Patent: Jan. 31, 2017

(54) FLOW DIRECTING DEVICE FOR A COOKING APPLIANCE

(75) Inventors: Ernst Claussen, Steinfeld (DE); Joachim J. Hylla, Acheffel (DE); Oliver Witt, Kiel (DE); Yingan Xia, Riesby (DE); Michael Herner, Landsberg am Lech (DE); Thomas Schreiner, Kaufering (DE); Robert Kurth, Augsburg (DE); Leonhard Ring, Sirchried (DE); Aldo Paintner, Landsberg am Lech (DE)

(73) Assignee: Rational AG (DE)

( * ) Notice: Subject to any disclaimer, the term of this patent is extended or adjusted under 35 U.S.C. 154(b) by 1147 days.

(21) Appl. No.: 13/125,793

(22) PCT Filed: Oct. 23, 2009

(86) PCT No.: PCT/EP2009/064020

§ 371 (c)(1),
(2), (4) Date: Jun. 24, 2011

(87) PCT Pub. No.: WO2010/046491

PCT Pub. Date: Apr. 29, 2010

(65) Prior Publication Data

US 2011/0253123 A1 Oct. 20, 2011

(30) Foreign Application Priority Data

Oct. 24, 2008 (DE) ..... 10 2008 053 145

(51) Int. Cl.
*F24B 1/00* (2006.01)
*F24C 15/32* (2006.01)

(52) U.S. Cl.
CPC ..... *F24C 15/322* (2013.01); *F24C 15/32* (2013.01)

(58) Field of Classification Search
CPC ..... F24C 15/322; F24C 15/32; C21D 1/767
(Continued)

(56) References Cited

U.S. PATENT DOCUMENTS 2,039,429 A * 5/1936 Lydon ..... 432/176
3,759,241 A * 9/1973 Berkhoudt ..... 126/21 A
(Continued)

FOREIGN PATENT DOCUMENTS

DE 25 19 604 A1 11/1975
DE 34 28 330 A1 2/1985
(Continued)

OTHER PUBLICATIONS

DE3428330 Translation.*
(Continued)

*Primary Examiner* — Avinash Savani
*Assistant Examiner* — Aaron Heyamoto
(74) *Attorney, Agent, or Firm* — Jones Day

(57) ABSTRACT

A cooking appliance including an interior, a fan mechanism having at least one fan wheel in the interior, at least one first flow directing member for subdividing the interior into a pressure chamber that houses the fan wheel and a cooking chamber, in which the first flow directing member includes at least one suction port for sucking atmosphere from the cooking chamber into the pressure chamber when the fan wheel is in operation and at least one blow-off port for blowing atmosphere from the pressure chamber into the cooking chamber when the fan wheel is in operation; and at least one second flow directing member that is included with the fan mechanism in the area of the suction port of the first flow directing member in order to improve the flow from the cooking chamber into the pressure chamber by forcing an axial main flow H in the suction zone of the fan mechanism, where the second flow directing member performs a nozzle
(Continued)

function, extends from the fan mechanism into the cooking chamber, and overlaps the edge of the suction port of the first flow directing member, and where the first flow directing member extends into the second flow directing member.

19 Claims, 3 Drawing Sheets

(58) Field of Classification Search
USPC ..... 126/15 A, 21 A; 432/176
See application file for complete search history.

(56) References Cited

U.S. PATENT DOCUMENTS

| | | | | |
|---|---|---|---|---|
| 3,978,843 | A * | 9/1976 | Durth | 126/21 A |
| 3,991,737 | A * | 11/1976 | Del Fabbro | 126/21 A |
| 4,108,139 | A * | 8/1978 | Gilliom et al. | 126/21 A |
| 4,395,233 | A * | 7/1983 | Smith et al. | 432/176 |
| 4,426,923 | A * | 1/1984 | Ohata | 99/468 |
| 4,430,541 | A * | 2/1984 | Day, Jr. | 219/683 |
| 4,484,561 | A * | 11/1984 | Baggott et al. | 126/21 A |
| RE31,765 | E * | 12/1984 | Guibert | 219/400 |
| 4,635,610 | A * | 1/1987 | Nakanishi | 126/21 A |
| 4,780,596 | A * | 10/1988 | Matsushima et al. | 219/400 |
| 4,908,488 | A * | 3/1990 | Park | 219/681 |
| 4,963,091 | A * | 10/1990 | Hoetzl et al. | 432/176 |
| 5,127,827 | A * | 7/1992 | Hoetzl et al. | 432/72 |
| 5,131,841 | A * | 7/1992 | Smith et al. | 432/59 |
| 5,142,125 | A * | 8/1992 | Fioroli et al. | 219/400 |
| 5,228,385 | A * | 7/1993 | Friedrich et al. | 99/352 |
| 5,586,861 | A * | 12/1996 | Berger | F04D 27/00 415/118 |
| 5,909,533 | A * | 6/1999 | Kitabayashi et al. | 392/310 |
| 6,521,870 | B2 * | 2/2003 | Graves et al. | 219/400 |
| 6,933,472 | B1 * | 8/2005 | Smith et al. | 219/400 |
| 7,087,864 | B2 * | 8/2006 | Oh et al. | 219/400 |
| 7,087,873 | B2 * | 8/2006 | Hayakawa et al. | 219/682 |
| 7,102,105 | B2 * | 9/2006 | Oh | 219/400 |
| 7,297,904 | B2 * | 11/2007 | Paller | F24C 15/322 126/21 A |
| 7,967,002 | B2 * | 6/2011 | Inada et al. | 126/21 A |
| 8,106,334 | B2 * | 1/2012 | Nam | 219/400 |
| 2006/0137675 | A1 * | 6/2006 | Kim et al. | 126/21 A |
| 2009/0013987 | A1 * | 1/2009 | Akdag et al. | 126/21 A |
| 2009/0013988 | A1 * | 1/2009 | Kim et al. | 126/21 A |
| 2009/0064984 | A1 * | 3/2009 | Kuhne | 126/21 A |
| 2009/0090347 | A1 * | 4/2009 | Kim et al. | 126/21 A |
| 2009/0110592 | A1 * | 4/2009 | Lee et al. | 422/5 |
| 2009/0178664 | A1 * | 7/2009 | Valentine et al. | 126/21 A |
| 2009/0178665 | A1 * | 7/2009 | Weber et al. | 126/21 A |
| 2009/0314276 | A1 * | 12/2009 | Yamasaki et al. | 126/21 A |

FOREIGN PATENT DOCUMENTS

| | | | |
|---|---|---|---|
| DE | 3428330 | A1 * | 2/1985 |
| DE | 203 09 268 | U1 | 6/2004 |
| DE | 203 12 031 | U1 | 6/2004 |
| DE | 203 14 818 | UI | 6/2004 |
| DE | 10 2004 004 393 | B3 | 5/2005 |
| DE | 10 2007 023 767 | A1 | 11/2008 |
| EP | 1 344 986 | A1 | 9/2003 |
| EP | 1 767 869 | A2 | 3/2007 |
| EP | 2072911 | A1 * | 6/2009 |
| FR | 2 660 418 | A1 | 10/1991 |
| GB | 1 414 546 | A | 11/1975 |
| JP | 56-20656 | | 10/1982 |
| JP | 2003-232521 | A | 8/2003 |

OTHER PUBLICATIONS

International Search Report dated Jun. 7, 2010 for International Application No. PCT/EP2009/064020.
International Search Report dated Jun. 7, 2010 for International Application No, PCT/EP2009/064020, English Translation.
Written Opinion of the International Research Authority Jun. 7, 2010 for International Application No. PCT/EP2009/064020.
Written Opinion of the International Research Authority Jun. 7, 2010 for International Application No. PCT/EP2009/064020, English Translation.
State Intellectual Property Office of the People's Republic of China, Second Office Action in Application No. 200980142201.2, issued Sep. 18, 2013.
State Intellectual Property Office of the People's Republic of China, Decision of Rejection in Application No. 200980142201.2, issued Mar. 5, 2014.
Japanese Patent Office, Notice of Reasons for Rejection, patent application No. 2011-532655, Oct. 15, 2013.

* cited by examiner

FLOW DIRECTING DEVICE FOR A COOKING APPLIANCE

CROSS-REFERENCE TO RELATED APPLICATIONS

This application is a national stage application of International Application No. PCT/EP2009/064020, filed on Oct. 23, 2009, which claims the benefit of German Patent Application No. DE 10 2008 053 145.6, filed on Oct. 24, 2008, the entire contents of both applications are incorporated herein by reference in their entireties.

BACKGROUND OF THE INVENTION

Field of the Invention

Embodiments of the present invention relate to a flow directing device for a cooking appliance with a fan mechanism, which comprises at least one fan wheel in an interior of the cooking appliance for circulating atmosphere, comprising at least one first flow directing member for subdividing the interior into a pressure chamber with the fan wheel and a cooking chamber, wherein the first flow directing member leaves free at least one suction port for sucking atmosphere from the cooking chamber into the pressure chamber in the area of the fan wheel and at least one blow-off port for blowing atmosphere from the pressure chamber into the cooking chamber when the fan wheel is in operation, at least one second flow directing member, which is mounted onto the fan mechanism or molded with the fan mechanism in the area of the suction port of the first flow directing member in order to improve the flow from the cooking chamber into the pressure chamber by forcing an axial main flow in the suction zone of the fan mechanism, and a cooking appliance with such a flow directing device.

Description of the Related Art

In the prior art, numerous measures for optimising a flow in the interior of a cooking appliance are known. Usually, a first flow directing member is used in the form of an air directing plate between a cooking chamber and a fan chamber or pressure chamber, which comprises a central suction port and leaves open blow-off ports facing the walls of the interior, so that a fan wheel arranged in the pressure chamber can suck atmosphere from the cooking chamber through the suction port and blow it out via the blow-off ports.

DE 203 14 818 U1, for example, deals with the targeted blowing of atmosphere from the pressure chamber into the cooking chamber via specially arranged blow-off ports in the first flow directing member. DE 10 2007 023 767, which is not pre-published, also deals with the blow-off ports of a first flow directing member, wherein movable elements should be arranged in blow-off ports, which move depending on the pressure progression in the cooking chamber. Another approach can be found, for example, in DE 203 09 268 U1 by using second flow directing members in the fan chamber in which a breaking up of the eddies should be forced while passing through a blow-off port between the pressure chamber and the cooking chamber, so that eddies spread out in the cooking chamber. Second flow directing members for forcing a homogeneous flow in the cooking chamber are also described in DE 203 12 031 U1.

A further flow directing device can be found, for example, in DE 10 2004 004 393 B4, in which a first flow directing member is in the form of a single piece with a second flow directing member. More precisely, the edge of the first flow directing member is turned in the form of an air directing plate in the area of its suction port to form a flow directing nozzle. This nozzle is a suction nozzle and is designed to improve the suction of atmosphere from a cooking chamber into a fan chamber of a cooking appliance. However, the disadvantage here is that a gap must be present at all times between a rotating fan wheel in the pressure chamber on the one hand, and the suction nozzle on the air directing plate on the other, in order to avoid damage. With cooking appliances in industrial kitchens in particular, this gap is large enough, due to tolerances, to enable atmosphere to flow from the pressure chamber directly into the suction area of the fan wheel, i.e., it is not directed via a blow-off port into the cooking chamber and via the suction port of the air directing plate into the suction area of the fan wheel, so that a short-circuit occurs with the atmosphere, which flows in from the cooking chamber through the suction port of the air directing plate. For this reason, this flow, which penetrates through the gap, is also known as a short-circuit flow, and occurs at a very sensitive point in the suction area of the fan wheel, i.e., in the deflection area of a main flow from the cooking chamber into the pressure chamber, more precisely, where a deflection occurs from a radial direction into an axial direction of the main flow. Thus, the short-circuit flow runs transverse to the main flow in the suction area of the fan wheel, so that it narrows the main flow and can itself cause a displacement and swirling of the main flow, which leads to an overall reduction in the effectiveness of the circulation of cooking chamber atmosphere by the fan wheel.

Generic flow directing devices for cooking appliances are described in EP 1 767 869 A2 and DT 25 19 604, wherein in both cases, a first flow directing member spreads out at least up to the suction port of a fan wheel, and in the case of DT 25 19 604, even extends into the suction port, while the second flow directing member is provided in the form of an outer contour of the fan wheel.

SUMMARY OF THE INVENTION

The object of the embodiments of the present invention is therefore to further develop the generic flow directing device in such a manner that it overcomes the disadvantages of the prior art. In particular, the effectiveness of a circulation within the interior of a cooking appliance should be improved.

This object is attained according to the embodiments of the present invention by means of the fact that each second flow directing member fulfils or performs a nozzle function, extends from the fan mechanism into the cooking chamber, and protrudes over or overlaps the edge of the suction port of the first flow directing member, while the first flow directing member spreads out into each second flow directing member.

Here, it is preferred that in cases when the fan mechanism comprises at least one radial fan, which includes a plurality of blades that are attached to a holding device, in particular, in the form of a support ring, and are arranged concentrically with a drive shaft, the second flow directing member is attached or molded with the shaft, the holding device, in particular, the support ring, and/or at least one blade.

According to embodiments of the present invention, it can here in turn be provided that the second flow directing member is in the form of a ring, in particular when attaching it to the holding device or molding it to the holding device.

Embodiments of the present invention are also directed to second flow directing members that extend into the pressure chamber up to the pressure area of the fan wheel.

Furthermore, it can be provided that each second flow directing member comprises a profile form of such a type that a flow from the cooking chamber into the pressure chamber only separates from the axial main flow as far as possible inside the pressure chamber, wherein preferably, an essentially hook-shaped profile or, in particular an asymmetric, U-shaped profile with an extended free end of the second flow directing member, is molded in the pressure chamber.

Additionally, embodiments of the present invention are directed to first flow directing members that are attached or are attachable to a wall of the interior.

Further embodiments of the present invention can also include by a third flow directing member in the pressure chamber, which, in particular, limits a blow-off area of the radial fan that extends conically outwards from the fan wheel of the radial fan.

Additionally, the third flow directing member can be attached to the first flow directing member, or can be moulded together with it.

Alternatively, the third flow directing member can be an extension of the second flow directing member, in particular at the free end of the second flow directing member in the pressure chamber.

According to the embodiments of the present invention, it is also recommended that the first flow directing member, the second flow directing member and/or the third flow directing member is or are in each case molded from at least one punched bending part and/or plate and/or is or are detachably affixed and/or is or are at least partially movable, or movable in sections.

Furthermore, the end of the second flow directing device can extend into the pressure chamber into a recess in the first and/or third flow directing device.

Particularly advantageous embodiments of the present invention are characterized by a plurality of fourth flow directing members, in particular, one fourth flow directing member for each blade, wherein, preferably, each fourth flow directing member is designed as a blade and/or as a blade extension, and most preferably extending through the support ring.

The embodiments of the present invention also provide a cooking appliance with a heating mechanism for heating atmosphere in a cooking chamber, a fan mechanism for circulating atmosphere at least in the cooking chamber and a flow directing device according to the embodiments of the present invention.

Additionally, the first flow directing member, the second flow directing member and/or the third flow directing member can be movable at least partially or in sections, preferably via a control or regulating mechanism, which interacts with the heating mechanism, the fan mechanism, a steam feed mechanism, a steam removal mechanism, a cooling mechanism, an energy saving mechanism, a microwave source, a gas feed mechanism, a gas removal mechanism, a sensing mechanism and/or a cleaning mechanism.

Finally, a shield, which can be of a grid or screen type, at least of the second flow directing member in the cooking chamber, can be affixed or is affixable in particular, to the first flow directing member, preferably in a detachable manner.

The embodiments of the present invention are thus based on the surprising finding that on the one hand, at least one first stationary flow directing member, for example, in the form of a standard air directing plate, is used in the interior of a cooking appliance, in order to separate the interior into a pressure chamber and a cooking chamber, wherein the first flow directing member leaves free a central suction port and at least one blow-off port on the edge side, and is affixed to the wall of the interior, while on the other hand, at least one second flow directing member is used, which fulfils or performs the function of a nozzle and which extends from a fan wheel in the pressure chamber, to which it is attached or molded together, through the suction port of the first flow directing member, so that the second flow directing member turns with the fan wheel. In a particularly advantageous manner, the nozzle, in particular, in the form of a ring is attached to a support ring for the blades of a radial fan, or is formed from a plurality of blade extensions. In any case, due to the nozzle, which rotates with the fan wheel, a radial flow is avoided in the suction area of the fan wheel, and thus, a short-circuit flow is also prevented. This increases the efficiency of the fan wheel and reduces the sensitivity of the entire cooking appliance to size tolerances.

Because radial fans are in principle relatively compact and are highly efficient, they are preferably used with a flow directing device according to the embodiments of the present invention. The high pressure area (the pressure side of the fan) and the suction area (the suction side of the fan) of a radial fan are relatively close to each other, so that due to the nozzle on the radial fan, a significant increase in fan capacity or reduction in the consumption capacity of the fan motor, is provided.

When the nozzle and the blades of the radial fan are affixed to a shared shaft, a separate fan housing is no longer required. The air directing plate and the nozzle, together with a wall of the interior, which is arranged opposite the air directing plate, form a type of fan housing. However, it is preferred that a shield is provided over the suction area of the radial fan in the cooking chamber in order to avoid injury, and is preferably attached to the first flow directing member.

Due to the size and geometry of the nozzle, further advantages can be attained, namely for the targeted directing of the flow. If the nozzle extends, on the one hand, in the pressure chamber into the area in which the blades of the radial fan create a pressure increase, the quantity of short-circuit flow is further reduced. If, on the other hand, the nozzle extends into the cooking chamber, an eddy formation in the suction area of the radial fan is reduced.

It is preferred according to the embodiments of the present invention that a third flow directing member is also used, which ensures that in the blow-off area of the radial fan, the pressure chamber comprises a chamber that extends radially outwards, so that the third flow directing member acts as a diffuser and further reduces the occurrence of short-circuit flows. The third flow directing member can be realised together with the first flow directing member.

Further features and advantages of the embodiments of the present invention are explained in the description of exemplary embodiments below with reference to the accompanying figures described below.

DETAILED DESCRIPTION

Figure 1:
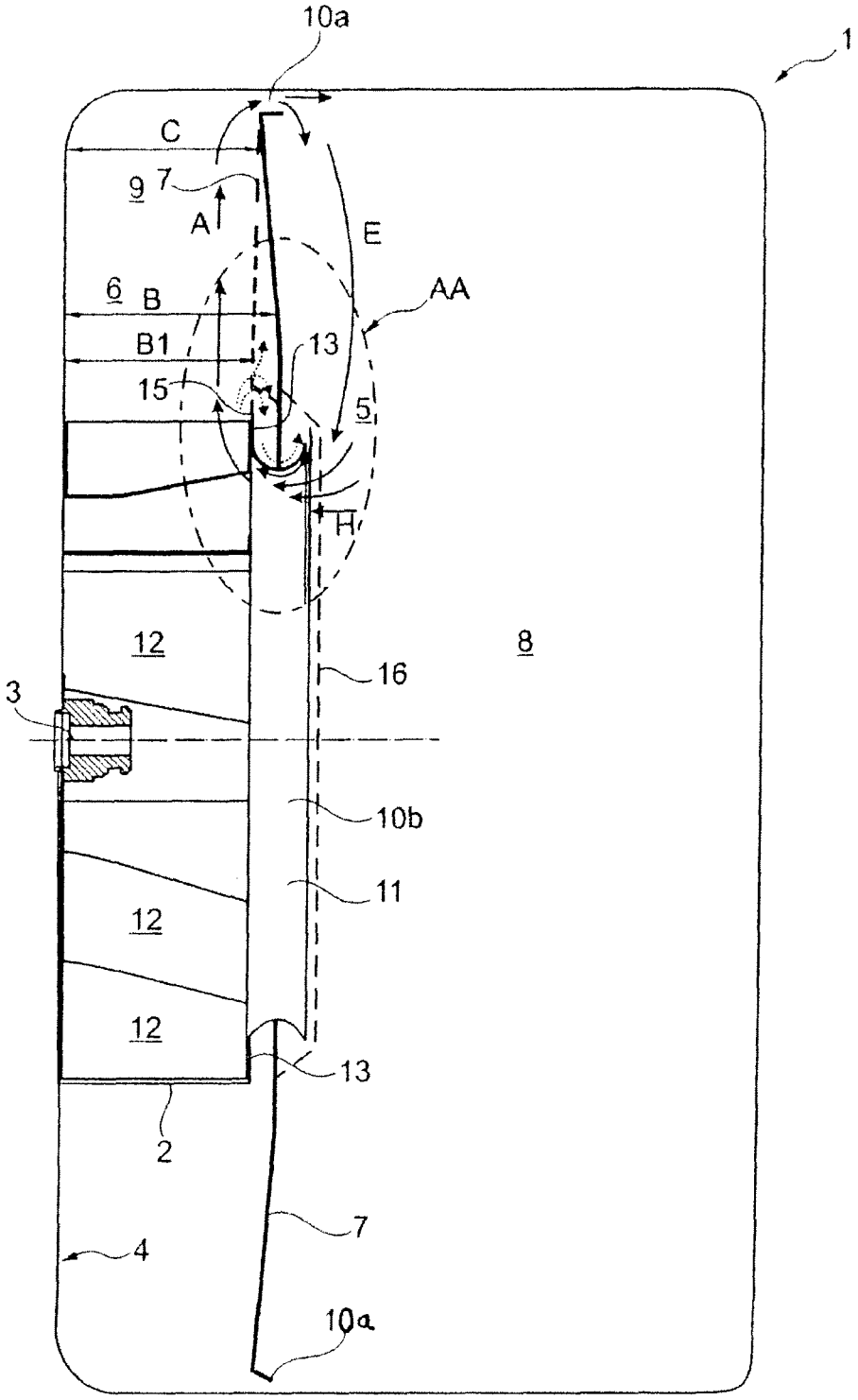
FIG. 1 shows a partial profile view of a cooking appliance according to an embodiment of the present invention.

A cooking appliance according to the embodiments of the present invention comprises, as is shown in FIG. 1, an interior 1, which houses a fan wheel 2 in the form of a radial fan wheel. The fan wheel 2 is mounted on a drive shaft 3 of a motor (not shown), which is located outside the interior 1. If, as an alternative, the motor were to be located inside the interior 1, then cooling measures would be required.

Although in principle, an axial fan could also be used, a radial fan has the advantage that atmosphere, which is brought into rotation, in particular cooking chamber atmosphere, does not impact against a rear wall 4 of the interior 1, but is instead deflected into the fan wheel 2. As a result, the arrangement is compact and has a high degree of efficiency.

The fan wheel 2 sucks in atmosphere centrally, namely, from a suction area 5, (see the suction flow E in FIG. 1), and blows it off radially, namely, into a blow-off area 6, (see the blow-off flow A in FIG. 1). In principle, a variant would also be feasible in which the atmosphere flows in the reverse direction, wherein measures would then have to be provided in order to avoid a transverse flow in the blow-off area 6.

The interior 1 is divided by a first flow directing member, for example, in the form of an air directing plate 7, at least partially into a cooking chamber 8 and a pressure chamber 9. The air directing plate 7 is, for example, affixed in a detachable and lockable manner via bridges or bars (not shown) to the walls of the interior 1. The fan wheel 2 is mounted separately in the cooking appliance, namely, with the fan wheel 2 in the pressure chamber 9, without a fixed connection to the air directing plate 7. The air directing plate 7 leaves gaps 10*a* on its outer edges open for the blow-off flow A and comprises a central opening 10*b* for the suction flow E, which is regulated in accordance with the suction area 5.

Due to the circulation of the atmosphere in the interior 1, evened heating of the item of food to be cooked (not shown) in the cooking chamber 8 is possible after the atmosphere has been heated using a heating means (not shown), both in conventional ovens and baking and roasting ovens, which also have a steam function and/or microwave charge, for example. The heating means can be designed in the form of heating coils around the fan wheel 2, for example.

In order to improve the deflection of atmosphere from the suction area 5 into the fan wheel 2, and to avoid transverse and counterflows, which could lead to short-circuit flows that could negatively impact the capacity of the fan, a nozzle 11 is provided as a second flow directing member in the area of the opening 10*b* of the air directing member 7 on the fan wheel 2. The nozzle 11 primarily directs atmosphere in the axial direction into the fan wheel 2. As is shown in FIG. 1, atmosphere is predominantly sucked in in the radial edge area of the suction area 5 of the fan wheel 2 in the form of a main flow H, for which reason the nozzle 11 is not only matched in terms of its arrangement and size to the suction area 5, but also to the opening 10*b* of the air directing plate 7.

The fan wheel 2 comprises blades 12. The end of each blade 12, which, from the perspective of the axial direction, is located on the suction side of the fan wheel 2, is here restricted by a ring-shaped wall 13 of a support ring, which is part of the fan wheel 2 and which is thus affixed on the shaft 3 in such a manner that it rotates. The nozzle 11 as depicted in the exemplary embodiment shown in FIG. 1, is firmly attached to this support ring or to this ring-shaped wall 13 and is itself in the form of a ring, so that a continuous sealing off of the pressure chamber 9 against the main flow H is provided. As a result, transverse and counterflows are to a large extent avoided in the area of the main flow H.

In an alternative embodiment, the nozzle can be affixed in another manner to the fan wheel for the purpose of avoiding the aforementioned transverse and counterflows. In principle, it would be possible, for example, to mount the nozzle onto an extension of the shaft in such a manner that it either rotates or does not rotate, which, however would require a precise maintenance of tolerance limits in terms of the distance between the fan wheel and the nozzle, which should be kept as small as possible. This, however, would not be advantageous. By contrast, it is advantageous to mold the nozzle in the form of additional blades that extend from the wall 13 in the direction of the air directing plate 7, or that extend as extensions of the blades 12, which extend through the wall 13 in the direction of the air directing plate 7. This embodiment enlarges the suction area 5 of the fan wheel 2 while maintaining the same installation space. Furthermore, the conveyance capacity of the fan wheel 2 is also enlarged, so that the cooking speed is increased or the capacity of the fan drive can be reduced. At the same time, the ejection behaviour of the fan wheel 2 is improved due to the fact that the profile through which the flow moves is enlarged when the fan wheel 2 is left. Due to the larger profile through which the flow moves, circulation around the heating means is also more effective, which leads to an improved heating of the item of food to be cooked.

Whether the nozzle 11 is in the form of a ring or in the form of a plurality of blade extensions on the support ring wall 13, has no influence over the fact that the opening 10*b* of the air directing plate 7 can be relatively freely selected, and the cooking appliance is no longer dependent to a high degree on tolerances with regard to the flow directing members 7, 11.

With regard to FIG. 2, the progression of the various flows between the pressure chamber 9 and the cooking chamber 8 will now be described in detail.

In the area between the fan wheel 2, which rotates when in operation, and the air directing plate 7, there is a gap 14. The gap 14 here is of such a size that it is guaranteed that the rotating fan wheel 2 together with the nozzle 11 under no circumstances brushes against the air directing plate 7, which does not rotate. The dimensions of the gap 14 are in a way dependent on the production tolerances of both the air directing plate 7 or its opening 10*b*, of the fan wheel 2 or its blades 12, of the wall 13, and of the nozzle 11. The gap 14 opens a connection between areas with large pressure differences that leads to a counterflow G, which separates from the blow-off flow A, and which flows from the pressure chamber 9 into the cooking chamber 8, more precisely from the blow-off area 6 of the fan wheel 2 into its suction area 5. In order for this counterflow G to run first radially in the pressure chamber 9 in the direction of the rotation axis of the fan wheel 2, then essentially axially in the area of the air directing plate 7, and finally radially outwards in the cooking chamber 8 in order to avoid to the greatest extent possible an interaction with the main flow H, i.e. to form no short-circuit flow, the nozzle 11 extends from the perspective of the axial direction until at least up to the opening 10*b* in the air directing plate 7. In order to prevent the counterflow G from immediately flowing back into the suction area 5, the nozzle 11 itself protrudes through the opening 10*b* into the cooking chamber 8. Furthermore, the counterflow G is deflected away in the radial direction from the suction flow E by the nozzle 11 widening out towards the suction area 5. The radius of the edge 15 of the nozzle 11, which faces away from the cooking chamber 8, is by contrast larger than the radius of the opening 10*b* in the air directing plate 7. As a result, the flow resistance of the gap 14 is increased, on the one hand, and on the other hand the strength of an eddy formation and the volume of the counterflow G, is are reduced.

In order to prevent the rotating nozzle 11 from touching objects located in the cooking chamber 8, such as an oven rack or similar structures, an air permeable shield 16 is provided. This shield 16, which can be, for example, in the form of a grid or screen, is attached to the air directing plate 7 and also serves to protect against injury by preventing access to the fan wheel 2.

An eddy formation can be further reduced in one embodiment according to embodiments of the present invention by the use of a third flow directing member in the form of an additional air directing plate 17 which functions as a diffuser. The additional air directing plate 17 can be mounted onto the first air directing plate 7 or be molded with the first air directing plate 7. In any case, a distance B1 between the additional air directing plate 17 and the rear wall 4 of the pressure chamber 9 is increased radially outwards relative to the longitudinal axis of the shaft 3 (rotation axis of the fan wheel), at least in the blow-off area 6. The blow-off flow A, which flows out of the fan wheel 2 thus reaches the blow-off area 6 without significant changes to its profile, and flows onwards to the gaps 10*a* between the first air directing plate 7 and the interior wall, wherein due to the flow directing mechanisms, eddy formations are avoided and short-circuit flows are reduced.

The invention is not restricted to the embodiments described in detail herein, but can be varied within the scope of protection of the appended claims. For example, the edge 15 of the nozzle 11 can protrude into a recess formed by a branching of the first and/or second air directing plate 7, 9 for the purpose of further increasing the resistance experienced by the counterflow G.

Figure 3:
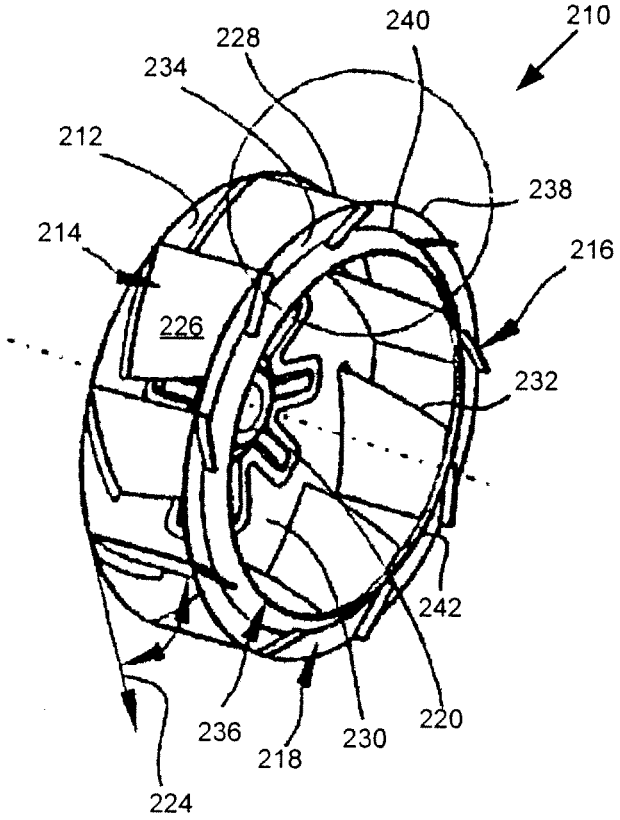
FIG. 3 shows a perspective view of an alternative fan wheel for a cooking appliance according to an embodiment of the present invention.

An alternative fan wheel, or radial fan wheel 210 is shown in FIG. 3 and comprises a disc-shaped bearing disc 212, several main blades 214, which are affixed on the bearing disc 212 with the same degree of separation, and a support or bearing ring 218, which is equipped with directing blades 216 and which is affixed at a distance to the bearing disc 212 on the main blades 214.

The bearing disc 212 is provided with a central recess 220, wherein a central axis of the recess 220 corresponds with a central axis 222 of the bearing disc 212. In an area located radially in the interior, the bearing disc 212, which is produced from a plate board, is provided with a hub designed to guarantee a reliable attachment to a drive device (not shown) and a stable radial runout of the radial wheel 210, even under high rotational speeds. The main blades 214 are with the present embodiment arranged in such a manner that they incline backwards on the bearing disc 212. In other words, a rotational speed vector 224, which is applied tangentially on the outer circumference of the bearing disc 212, incorporates an acute angle with a largest surface 226 of the main blade 214, as is shown symbolically in FIG. 3.

With the embodiment of the radial wheel 210 shown in FIG. 3, the directing blades 216 are designed as a single piece with the main blades 214 so that largest surfaces of the directing blades 216 incorporate the same acute angle with the rotational speed vector 224 as the largest surfaces 226 of the main blades 214. The main blades 214 are in each case angled at right-angles on an end area, which is set opposite the directing blades 216, so that they can be affixed by adhesive bonding, for example, by glueing or spot-welding, to the bearing disc 212 which is preferably made of metal.

The directing blades 216 protrude orthogonally from the surface of the bearing disc 212.

The bearing ring 218 is provided with slits, not shown in greater detail, which are punctuated by the directing blades 216, which are connected as a single piece with the main blades 214. The directing blades 216 are affixed using a adhesively bonded connection, in particular a weld or solder connection, to the bearing ring 218, and protrude orthogonally from said ring. Radially external front sides of the main blades 214 and of the directing blades 216 are with the present embodiment of the radial wheel, aligned orthogonally to a largest surface 230 of the bearing disc 212. Radially internal front sides 232 of the main blades 214 are curved, and thus only essentially aligned orthogonally to the largest surface 230 of the bearing disc 212.

As depicted in FIG. 3, the bearing ring 218 of the present embodiment, is designed as a single piece, made of a planar ring 234 and a suction mouth 236, which connects radially internally, and is formed as a cone sheath section profile, and which provides a nozzle and thus also acts as a second flow directing member. The directing blades 216 are sized in such a manner that they extend from the radially external edge 238 of the planar ring 234 through to the radially internal edge 240 of the planar ring 234. The inner edge 242 of the suction mouth 236 limits the suction profile of the radial wheel 210.

Figure 2:
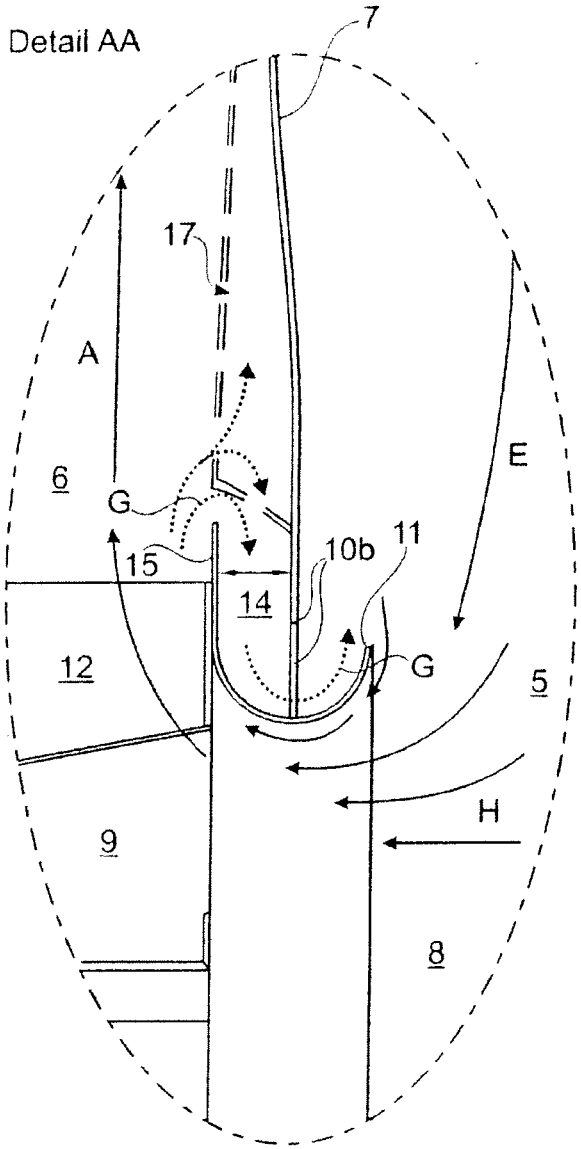
FIG. 2 shows an enlarged view of detail AA in FIG. 1.

Cooking chamber atmosphere that is sucked in by the radial wheel 210 and which flows through the suction port of a first flow directing member according to FIGS. 1 and 2, is either directed through the suction mouth 236, i.e., the second flow directing member, and accelerated outwards by the main blades 214 in the radial direction, or enters a gap, which remains between the suction mouth 236 and the first flow directing member. In the gap, the directing blades 216 ensure that unwanted turbulences, which could reduce the effectiveness of a fan arrangement that is equipped with the radial wheel 210, are avoided. The directing blades 216 thus act as further flow directing members (fourth flow directing members) in order to increase the efficiency of the radial wheel 210.

The features of the embodiments of the present invention explained in the above description, in the drawings and in the claims, can be integral both individually as well as in any combination required in order to realise the invention in its different embodiments.

LIST OF REFERENCE NUMERALS

1 Interior
2 Fan wheel
3 Shaft
4 Rear wall
5 Suction area
6 Blow-off area
7 Air directing plate
8 Cooking chamber
9 Pressure chamber
10*a* Gap
10*b* Opening
11 Nozzle
12 Blade
13 Support ring wall
14 Gap
15 Edge
16 Shield
17 Air directing plate
210 Radial wheel
212 Bearing disc
214 Main blade

216 Directing blade
218 Bearing ring
220 Recess
222 Central axis
224 Rotational speed vector
226 Surface
230 Surface
232 Front side
234 Planar ring
236 Suction mouth/nozzle
238 Radially external edge
240 Radially internal edge
242 Inner edge
H Main flow
G Counterflow
E Suction flow
A Blow-off flow
B1 Distance

The invention claimed is:

1. A cooking appliance comprising:

an interior;

a fan mechanism including at least one fan wheel in the interior;

at least one first flow directing member for subdividing the interior into a pressure chamber that includes the fan wheel and a cooking chamber, wherein the first flow directing member includes at least one suction port for sucking atmosphere from the cooking chamber into the pressure chamber when the fan wheel is in operation and at least one blow-off port for blowing atmosphere from the pressure chamber into the cooking chamber when the fan wheel is in operation; and at least one second flow directing member that is affixed to the fan mechanism or molded with the fan mechanism in the area of the suction port of the first flow directing member in order to improve the flow from the cooking chamber into the pressure chamber by forcing an axial main flow in the suction zone of the fan mechanism, wherein the second flow directing member performs a nozzle function, reduces the volume of counterflow into the cooking chamber by extending from the pressure chamber into the cooking chamber, and overlaps an edge of the suction port of the first flow directing member, an opening formed between the first flow directing member and the second flow directing member that connects the cooking chamber and the pressure chamber, wherein the first flow directing member extends into the second flow directing member, and wherein the first flow directing member comprises an air directing plate that extends from the suction port and ends before the at least one blow-off port which forms a gap on an outer edge of the air directing plate.

2. The cooking appliance according to claim 1, wherein when the fan mechanism includes at least one radial fan comprising a plurality of blades that are attached to a holding device and that are arranged concentrically with a drive shaft, the second flow directing member is attached to or molded with at least one of the drive shaft, the holding device, and at least one blade.

3. The cooking appliance according to claim 2, wherein the second flow directing member is in the form of a ring.

4. The cooking appliance according to claim 1, wherein the second flow directing member extends into the pressure chamber up to a pressure area of the fan wheel.

5. The cooking appliance according to claim 1, wherein a profile of the second flow directing member prevents a flow from the cooking chamber into the pressure chamber from separating from the axial main flow H, for at least some distance into the pressure chamber.

6. The cooking appliance according to claim 1, wherein the first flow directing member is configured to be attached to a wall of the interior.

7. The cooking appliance according to claim 1 further comprising a third flow directing member in the pressure chamber that limits a blow-off area of the fan mechanism that extends conically outwards from the fan wheel of the fan mechanism.

8. The cooking appliance according to claim 7, wherein the third flow directing member is attached to the first flow directing member or is molded together with the first flow directing member.

9. The cooking appliance according to claim 7, wherein the third flow directing member is an extension of the second flow directing member.

10. The cooking appliance according to claim 7, wherein at least one of the first flow directing member, the second flow directing member, and the third flow directing member is molded from at least one of a punched bending part and a plate or is at least one of detachably affixed and at least partially movable.

11. The cooking appliance according to claim 7, wherein an end of the second flow directing member extends into the pressure chamber into a recess in the first and/or third flow directing device.

12. The cooking appliance according to claim 7 further comprising a plurality of fourth flow directing members, wherein each fourth flow directing member is in the form of a blade or a blade extension.

13. The cooking appliance according to claim 1 further comprising a heating mechanism for heating the atmosphere in the cooking chamber.

14. The cooking appliance according to claim 7 further comprising a heating mechanism for heating the atmosphere in the cooking chamber.

15. The cooking appliance according to claim 1, wherein a shield at least partially surrounds the second flow directing member in the cooking chamber.

16. The cooking appliance according to claim 2, wherein the holding device is a support ring.

17. The cooking appliance according to claim 5, wherein the profile is hook-shaped or an asymmetric U-shape having an extended free end that is molded in the pressure chamber.

18. The cooking appliance according to claim 12, wherein each fourth flow directing member corresponds to each blade and wherein each fourth flow directing member extends through a support ring.

19. The cooking appliance according to claim 15, wherein the shield is attached to the first flow directing member.

* * * * *